United States Patent [19]

Whelan

[11] Patent Number: 4,539,888

[45] Date of Patent: Sep. 10, 1985

[54] EXTENDED RANGE MUSICAL PIPE INSTRUMENT

[76] Inventor: Maurice Whelan, 60 Main St., Hastings-on-Hudson, N.Y. 10706

[21] Appl. No.: 583,377

[22] Filed: Feb. 24, 1984

[51] Int. Cl.[3] ..... G10D 7/06

[52] U.S. Cl. ..... 84/380 B; 84/330; 84/380 C; 84/386

[58] Field of Search ..... 84/330, 380 R, 380 B, 84/380 C, 381, 386

[56] References Cited

U.S. PATENT DOCUMENTS

| | | | |
|---|---|---|---|
| 1,069,200 | 8/1913 | Starck | 84/380 B |
| 2,478,323 | 8/1949 | Rohner | 84/380 C |
| 2,509,429 | 5/1950 | Grow | 84/380 B |
| 3,570,358 | 3/1971 | Guinness | 84/380 C |

FOREIGN PATENT DOCUMENTS

| | | | |
|---|---|---|---|
| 29532 | of 1910 | United Kingdom | 84/380 B |

*Primary Examiner*—Lawrence R. Franklin
*Attorney, Agent, or Firm*—John F. Ohlandt

[57] ABSTRACT

The invention relates to a hand held musical pipe instrument, such as a bagpipe, having a plurality of longitudinally spaced wall openings which are positioned and arranged to be selectively closed by finger action of the player. There is included a longitudinally slidable sleeve member positioned and arranged on the exterior of the pipe body for selective longitudinal positioning by one of the fingers of the player to at least partially cover or uncover one of the wall openings to thereby provide for a tone pitch change.

16 Claims, 7 Drawing Figures

EXTENDED RANGE MUSICAL PIPE INSTRUMENT

This invention relates to hand held musical pipe instruments with an extended range, and more particularly to such musical pipe instruments which are especially adapted for use as bagpipe chanters.

BACKGROUND OF THE INVENTION

A set of bagpipes typically includes a blowpipe, an airbag, several drone pipes and a chanter pipe. The chanter pipe is the one which includes a number of finger holes, often referred to herein as wall openings, by means of which the pitch of the chanter can be changed to play tunes. The present invention is limited to features to be incorporated in a variable pitch hand held musical pipe instrument such as a bagpipe chanter. Accordingly, the description is confined to a variable pitch pipe instrument, and insofar as this invention relates to bagpipes, the arrangement of the rest of the set of bagpipes is understood to be conventional. The invention is described specifically in conjunction with the chanter pipe for a set of bagpipes. However, it will be understood that it may be useful with other hand held musical pipe instruments as well.

The chanter for which this invention is particularly useful is known as an Irish war pipe chanter, or as a Scottish highland chanter. The term "chanter", as used in this specification, is understood to refer to that type of chanter. Such a chanter has eight longitudinally spaced wall openings which are intended to be selectively covered by the fingers of the player to produce the notes "G", "A", "B", "C", "D", "E", "F", "G", and "A".

In order to extend the range of a bagpipe chanter, various efforts have been made to provide for additional notes at the bottom and at the top of the normal bagpipe range. One of these typical efforts is illustrated, for instance, in U.S. Pat. No. 1,069,200 issued on Aug. 5, 1913 to Henry Starck for a Bagpipe Chanter. That patent provides for a substantially modified chanter employing key operated vent plates for selectively covering added wall openings for the purpose of extending the range of the chanter. The key actuated vent plates are of the conventional construction which is presently used on other pipe instruments such as saxophones and clarinets.

However, there are important disadvantages in such a structure. For instance, with the use of key operated vent plates, it is difficult to produce trilling notes involving the rapid opening and closing of the wall opening associated with the vent plate. Thus, the musical result is not as desirable and pleasing. Furthermore, a considerable change in technique is required for the actuation of the keys provided in such prior patents. Still further, the substantial modification of the chanter pipe, and the addition of the rather complicated key operated vent plate can be a very expensive modification to the standard bagpipe chanter.

Furthermore, with such an arrangement for extending the range, the modification of the bagpipe chanter must be very substantial, and is necessarily irreversible. Since bagpipe chanters are expensive, and since tastes and preferences may vary with regard to the extension of the range of the bagpipe chanter, it is undesirable to make a modification which cannot be reversed to permit the bagpipe chanter to be again used without the range extension feature.

Accordingly, it is one object of the present invention to provide an extended range hand held musical pipe instrument which provides a better result in terms of greater virtuosity in play, including the facility for ease in producing trilling notes.

Another object of the invention is to produce a modification for a hand held musical pipe instrument which is very economical, and yet very effective.

Another object of the invention is to provide a hand held musical pipe instrument, such as a bagpipe chanter, which has extended range features which are operable with a minimum in change in operating technique.

Another object of the invention is to provide an improved range extension modification for a bagpipe chanter which does not substantially modify the basic structure of the chanter, and which can, for the most part, be removed, to easily restore the chanter to substantially its original condition.

Other objects and advantages of the invention will be apparent from the following description and the accompanying drawings.

BRIEF DESCRIPTION OF THE INVENTION

In carrying out the invention there is provided a hand held musical pipe instrument comprising a pipe body which is adapted to be supplied with air at a first end and has the other end normally open with a plurality of intermediate longitudinally spaced openings in the wall thereof and wherein at least some of said wall openings are positioned and arranged to be selectively closed by finger action of the player, said instrument including a longitudinally slidable sleeve member positioned and arranged on the exterior of said pipe body for selective longitudinal positioning by one of the fingers of the player to at least partially cover or uncover one of said wall openings to thereby provide for a tone pitch change.

DETAILED DESCRIPTION OF THE PREFERRED EMBODIMENTS

Figure 1:
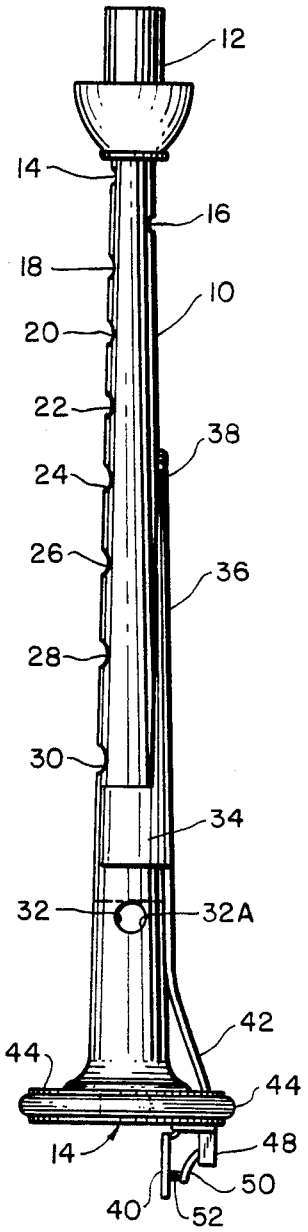
FIG. 1 is a side view of a bagpipe chanter illustrating a preferred embodiment of the present invention.

FIG. 1 is a side view of a hand held musical pipe instrument (a bagpipe chanter) having a pipe body 10 which is adapted to be supplied with air at the upper end 12, such as by means of a connector to a bagpipe bag. The other end 14 of the pipe body 10 is normally open, and a plurality of intermediate longitudinally spaced openings are arranged in the wall of the pipe body 10, as indicated at 14, 16, and 18 through 30. All of the wall openings just mentioned are positioned and arranged to be selectively closed by direct finger action of the player. Opening 16 is arranged for closure by the left thumb of the player. Openings 14, 18, 20, and 22, are arranged for closure by the four fingers of the left hand opposed to the thumb. Openings 24, 26, 28, and 30 are arranged for closure by the four fingers of the right hand of the player which are opposed to the thumb.

Two additional transverse wall openings 32 and 32A are provided near the open end 14 of the pipe body. These openings are in mutual alignment so that they appear as one in FIG. 1. It should be noted that these wall openings 32 and 32A are so-called "sound" holes, normally found in conventional chanters, but which are not designed to be finger controlled.

In accordance with the novel features of the present invention, a longitudinally slidable sleeve member 34 is arranged on the exterior of the pipe body 10 for selective longitudinal positioning by the right thumb of the player to at least partially cover or uncover the wall openings 32 and 32A to provide for a tone pitch change. The sleeve member 34 includes a longitudinal extension 36, which terminates at an upper end 38 which is adapted for engagement by the right thumb of the player for longitudinal positioning in relation to the wall openings 32 and 32A. It will therefore be appreciated that in the preferred embodiment no change is brought about in "normal" fingering in the sense that the fingers that have always been used for particular notes are so used with the invention. The thumb, which conventionally is inactive, is now assigned to perform the new function of achieving the low notes "E" and "F".

The sleeve member 34 is preferably unsymmetrical so that the far side of the sleeve member (the side hidden in FIG. 1) extends downward farther than the near side. This provides for selective closure of the two openings 32 and 32A as the slide member 34 is moved downwardly. This will be described more fully below in connection with FIGS. 2 through 5.

All of the wall openings illustrated in FIG. 1 are standard openings for a standard bagpipe chanter, except for the top most opening 14, which has been added to the chanter in accordance with one of the features of this invention. That additional wall opening need not necessarily be provided, and when not provided, the chanter is a standard chanter, which is modified only by the addition of the slidable sleeve member 34 and a shutter member which is about to be described.

In order to further modify the tone pitch provided by the pipe, a movable shutter device 40 is provided. Device 40 is actuable by an extension 42 of the sleeve member 34 to partially close the normally open end 14 of the pipe. This closed position of the shutter 40 corresponds to the lowermost position of the sleeve 34 in which both of the openings 32 are completely covered. That position of the sleeve provides a low "E" note. At an intermediate position of the sleeve member 34, the opening 32A is completely closed, and opening 32 is only half closed. That provides a low "F" note. These are notes which are added to the lower end of the normal range of the chanter. When the sleeve 34 is in the uppermost position, the normal range of chanter notes are available and the sleeve does not modify the chanter pitch.

The added wall opening 14, at the top of the chanter, provides an added high note "B" or "C" to the range of the chanter when it is opened. Specifically, when the added wall opening 14 is open and all of the other wall openings are open, the note "B" will be produced; whereas the note "C" is produced when all of the openings except opening 16 are open.

The extension 42 of the sleeve member 34 extends through a passage within the sole 44 of the chanter. The structure of this arrangement, as well as other features of the invention, and the operation thereof, are shown more fully in the other drawings and are described more fully below in conjunction with the other drawings.

Figure 2:
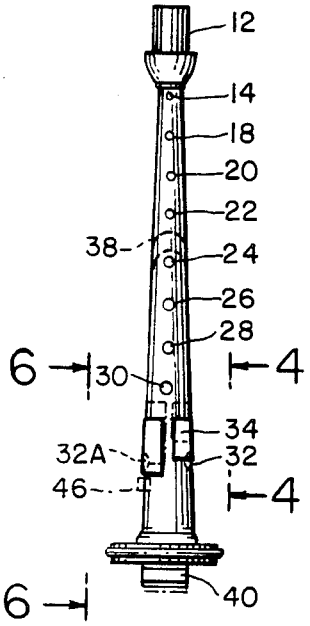
FIG. 2 is a front view of the bagpipe chanter of FIG. 1.

FIG. 2 is a front view of the chanter of FIG. 1, more clearly illustrating the wall openings 14, and 18 through 30. The sleeve 34 is shown as having a longitudinal split to accommodate for the tapered shape of the pipe body 10, while maintaining a snug engagement with the exterior surface of the pipe. The sleeve member is composed of an elastic material which has an unstressed diameter which is somewhat smaller than the exterior diameter of the smallest portion of the pipe body embraced by the sleeve so as to provide for a continuing snug fit of the sleeve member around the pipe body. The material of the sleeve member is preferably a synthetic resin material, and one prefered material for that purpose is a polyethylene. However, other materials may be employed such as one of the vinyls, or one of the nylons.

In FIG. 2, the slidable sleeve member 34 is shown in phantom in the uppermost position, as previously illustrated in FIG. 1, and is shown in full in the intermediate position, to produce the low "F" note, with the opening 32 only partially closed, and the opposite opening 32A being fully closed by the sleeve member 34. If desired, the invention may be employed only for the purpose of adding the low "F" tone corresponding to the position of the sleeve member 34 illustrated in FIG. 2, and the shutter 40 may be omitted, In such an embodiment, a stop member 46, illustrated in phantom in FIG. 2, may be provided to limit the downward movement of the sleeve 34.

Figure 3:
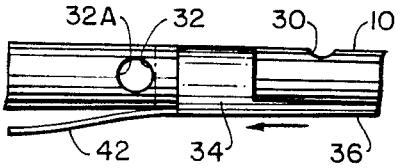
FIGS. 3, 4, and 5 are enlarged detail side views illustrating how a slidable sleeve member can be moved to different positions upon the body of the chanter pipe to close and partially close wall openings to change the pitch thereof.
Figure 4:
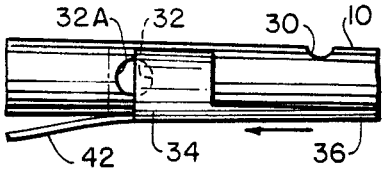
Figure 5:
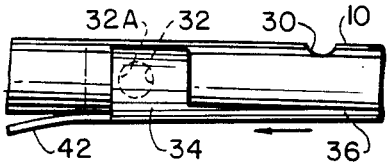

The operation of the slidable sleeve member in closing off the wall openings 32 and 32A is illustrated in more detail in the enlarged detail views of FIGS. 3, 4, and 5. In FIG. 3, the sleeve member 34 is in the uppermost position, with both of the openings 32 and 32A uncovered. In FIG. 4, the sleeve member has been moved downwardly to an intermediate position where opening 32A is completely covered, and opening 32 is only partially covered. This corresponds to the addition of the lower tone "F".

In FIG. 5, the sleeve member 34 has been moved down to cover both of the openings 32 and 32A (and to also close the shutter 40, not shown in FIG. 5), and to thus provide the lower tone "E".

Figure 6:
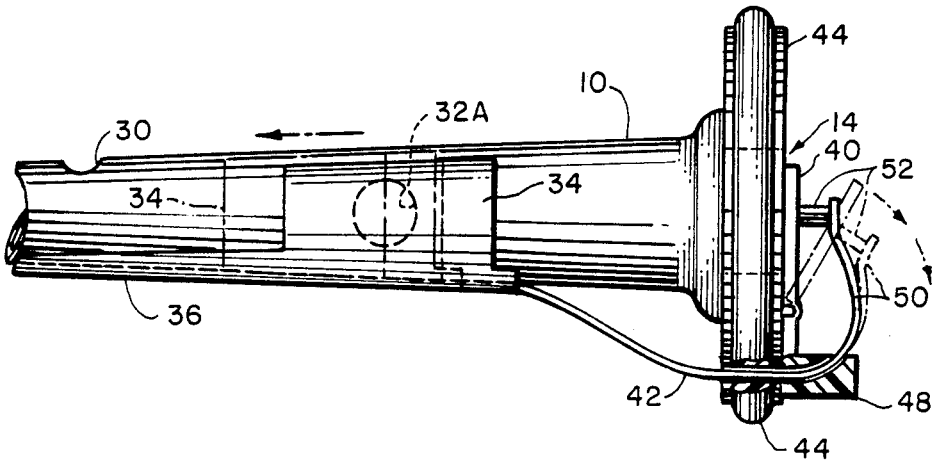
FIG. 6 is an enlarged partial side view of the normally open end of the musical pipe instrument together with the adjacent body portion, and illustrating details of the slide and also illustrating details of a shutter which is intended to partially close the normally open end of the pipe instrument for modification of the tone pitch.

FIG. 6 is an enlarged partial side view of the normally open end of the pipe, at the side opposite to the side illustrated in FIG. 1, and showing details of the shutter and the shutter actuation structure. The sleeve member 34 is illustrated in full in FIG. 6 in the lowermost position with both of the holes 32 and 32A fully covered, corresponding to the lower "E" note position. The lower "F" note position is shown in phantom, with the shutter 40 opened and with the sleeve member in the intermediate position with wall opening 32A closed and wall opening 32 only partially closed.

As indicated in FIG. 6, the extension 42 of the sleeve member 34 preferably extends through a passage in the sole 44, and through an extension of that passage in a guide member 48. The lower end of the extension 42 is attached at 50 to an actuation post 52 attached to the shutter 40. By this means, as the sleeve extension 42 slides through the sole and the guide member 48, it pushes against the actuation post 52, and causes the shutter to close.

Figure 7:
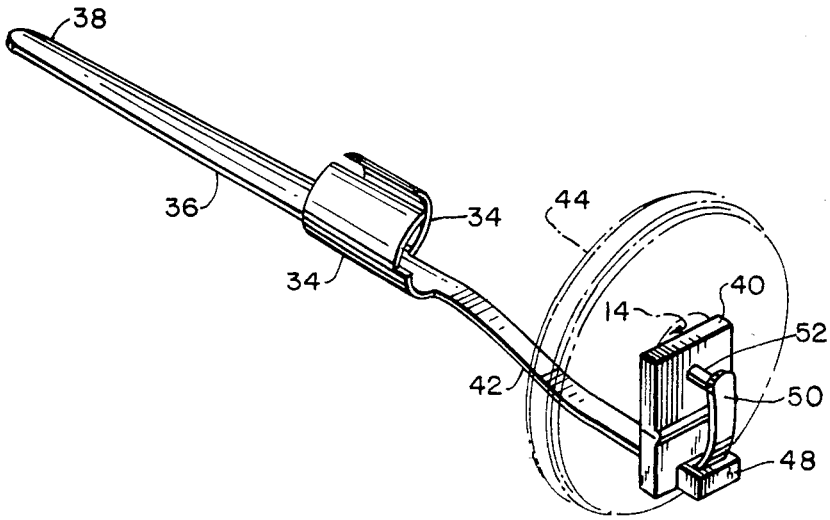
FIG. 7 is a perspective view of a slidable sleeve member as illustrated in the other figures, together with the associated shutter mechanism.

FIG. 7 is a perspective view of the most important components added to a standard chanter in accordance with the present invention in order to achieve the major objectives of the present invention. These include the sleeve member 34, the shutter 40, and a special sole 44 having the support for the shutter 40 and the guide member 48.

Since it is a simple matter to attach a new sole to a bagpipe chanter, in accordance with the present invention, the special sub-assembly illustrated in FIG. 7, including the special sole 44, can be easily installed in place of the conventional chanter sole, with the sleeve 34 attached around the shaft of the body 10 of the chanter. In this manner, the features of the present invention, involving the addition of the low notes "E" and "F", can be added easily to a standard chanter. In the instance where only the F note is to be added, it is only necessary to attach the sleeve member 34 to the shaft body 10, since the shutter 40 is not needed. In such instance, the extension 42 of the sleeve 34 may be omitted, or may be cut off.

While there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

I claim:

1. A hand held musical pipe instrument comprising a pipe body which is adapted to be supplied with air at a first end and has the other end normally open with a plurality of intermediate longitudinally spaced openings in the wall thereof and wherein at least some of said wall openings are positioned and arranged to be selectively closed by finger action of the player, said instrument including a longitudinally slidable sleeve member positioned and arranged on the exterior of said pipe body for selective longitudinal positioning by one of the fingers of the player to at least partially cover or uncover one of said wall openings to thereby provide for a tone pitch change.

2. An instrument as claimed in claim 1 wherein said sleeve member is longitudinally split on one side and wherein said sleeve member is composed of an elastic material and has an unstressed diameter which is somewhat smaller than the exterior diameter of that portion of said musical pipe instrument body embraced by said sleeve member to thereby provide a snug fit of said sleeve member around said pipe body.

3. An instrument as claimed in claim 2 wherein the elastic material of said sleeve member is comprised of a synthetic resin material.

4. An instrument as claimed in claim 3 wherein said synthetic resin material is a polyethylene.

5. An instrument as claimed in claim 2 wherein said sleeve member includes a longitudinal extension on one side thereof which is positioned and arranged to extend towards said first end of said pipe instrument body for engagement by one of the fingers of the player for the selective longitudinal positioning of said sleeve member upon said pipe body.

6. An instrument as claimed in claim 5 wherein most of said longitudinally spaced wall openings are arranged across the front of said pipe instrument body for engagement by the fingers of the player, and wherein said extension of said sleeve member is positioned and arranged along the back of said pipe instrument body for engagement by one of the thumbs of the player.

7. An instrument as claimed in claim 6 wherein said musical pipe instrument is adapted to be used as the chanter pipe in a set of bagpipes.

8. An instrument as claimed in claim 7 wherein the number and positioning of the longitudinally spaced wall openings is in a standard configuration for bagpipe chanters with the addition of an extra opening positioned close to said first end of said pipe instrument to provide for an extension of the range of said pipe by the addition of a high "C" tone.

9. An instrument as claimed in claim 7 wherein the one of said wall openings which is spaced most closely to said open end of said instrument is positioned and arranged to be at least partially covered by said slidable sleeve member in at least one position thereof, and is arranged to be uncovered by said sleeve member in another position thereof.

10. An instrument as claimed in claim 9 wherein a second wall opening is positioned and arranged opposite to said last mentioned wall opening nearest to said open end of said body and substantially equally spaced longitudinally in said body, said two last named wall openings both being positioned and arranged to be uncovered by said sleeve member in one position thereof, and said sleeve member being operable in another position to cover one of said two last mentioned wall openings and to only partially cover the other one of said two last mentioned wall openings.

11. An instrument as claimed in claim 10 wherein the note produced when said sleeve member is operable to cover one of said two last mentioned wall openings and to only partially cover the other one of said two last mentioned wall openings is a low "F" note.

12. An instrument as claimed in claim 10 wherein said sleeve member is operable in a third position to fully cover both of said two last mentioned wall openings.

13. An instrument as claimed in claim 12 wherein there is provided a shutter member connected and arranged for actuation by said sleeve member to partially close the normally open end of said pipe when said sleeve member is in the position to fully cover both of said two last mentioned wall openings.

14. An instrument as claimed in claim 13 wherein the tone pitch change achieved with said shutter closed and with said last mentioned wall openings closed is a low "E" note.

15. An instrument as claimed in claim 13 wherein said shutter is hingedly attached to said normally open end of said pipe body and wherein said sleeve member includes an elongated extension which extends beyond said normally open end of said body, and which is connected to said hinged shutter for actuation thereof.

16. An instrument as claimed in claim 1 wherein there is provided a shutter device connected and arranged for operation by said slidable sleeve member to partially close said normally open end of said pipe to thereby provide for a tone pitch change.

* * * * *